United States Patent [19]

Hale et al.

[11] Patent Number: 5,072,775

[45] Date of Patent: Dec. 17, 1991

[54] CORE BLOWING MACHINE

[75] Inventors: Roger W. Hale, Hinckley; Gerald B. Senk, Jr., Cleveland, both of Ohio

[73] Assignee: Equipment Merchants International, Inc., Cleveland, Ohio

[21] Appl. No.: 519,949

[22] Filed: May 7, 1990

Related U.S. Application Data

[63] Continuation-in-part of Ser. No. 220,082, Jul. 18, 1988, Pat. No. 4,942,916.

[51] Int. Cl.[5] ..... B22C 9/12; B22C 13/12; B22C 15/22

[52] U.S. Cl. ..... 164/186; 164/201; 164/228

[58] Field of Search ..... 164/186, 180, 200, 201, 164/228

[56] References Cited

U.S. PATENT DOCUMENTS

| | | | |
|---|---|---|---|
| 3,096,547 | 7/1963 | Hunter et al. | 164/186 |
| 3,556,195 | 1/1971 | Lund | 164/201 X |
| 4,559,989 | 12/1985 | Kawai et al. | 164/201 X |
| 4,711,292 | 12/1987 | Rommel et al. | 164/201 X |
| 4,714,100 | 12/1987 | Bellis et al. | 164/180 X |
| 4,832,108 | 5/1989 | Nagarwalla et al. | 164/186 X |

FOREIGN PATENT DOCUMENTS

| | | | |
|---|---|---|---|
| 57-70056 | 4/1982 | Japan | 164/201 |
| 59-87954 | 5/1984 | Japan | 164/201 |
| 59-144554 | 8/1984 | Japan | 164/201 |
| 1050807 | 10/1983 | U.S.S.R. | 164/228 |

*Primary Examiner*—J. Reed Batten, Jr.
*Attorney, Agent, or Firm*—Renner, Otto, Boisselle & Sklar

[57] ABSTRACT

A foundry core blowing machine includes an upright frame with a blow head for a sand-resin mix fixed at the top. Sectionalized vertically movable rods extend through bushings at the top and bottom of the frame. Fixed to the rods are a cope support and a secondary table. The secondary table supports the cylinder of a cope-drag clamp piston-cylinder assembly with the rod of such assembly being connected to a primary table thereabove which slidably moves on the rods. The secondary table and the rods secured thereto are elevated independently of the cope-drag clamp so that the clamped cope and drag may be elevated to be clamped against the blow head, lowered for interposition of a gassing head, and reclamped for cure, all while the cope and drag remain firmly clamped together. Only after curing are the cope and drag unclamped for lowering, stripping and removal of the core from the machine. The continuous high pressure clamp of the drag to the cope during blow and subsequent cure, even though the assembly is unclamped from the blow head prevents sand from entering between the abutting surfaces of the cope and drag and the forming of finning. The rods are formed in sections with the center section being readily replaced with rods of different height to control the shut height or window of the machine. The machine includes a removable blow plate and a shuttling gassing head. Both the blow plate and cope may quickly be secured to and released from the machine, so that tooling sets, even including the gassing head, may be assembled on a power operated tooling change conveyor and quickly assembled into and out of the machine upon vertical movement of the primary and secondary tables, each with a single cycle of the machine. The machine may also include a shuttling curing gas supply nozzle for automated connection/disconnection with the shuttling gassing head during tooling cycles.

10 Claims, 12 Drawing Sheets

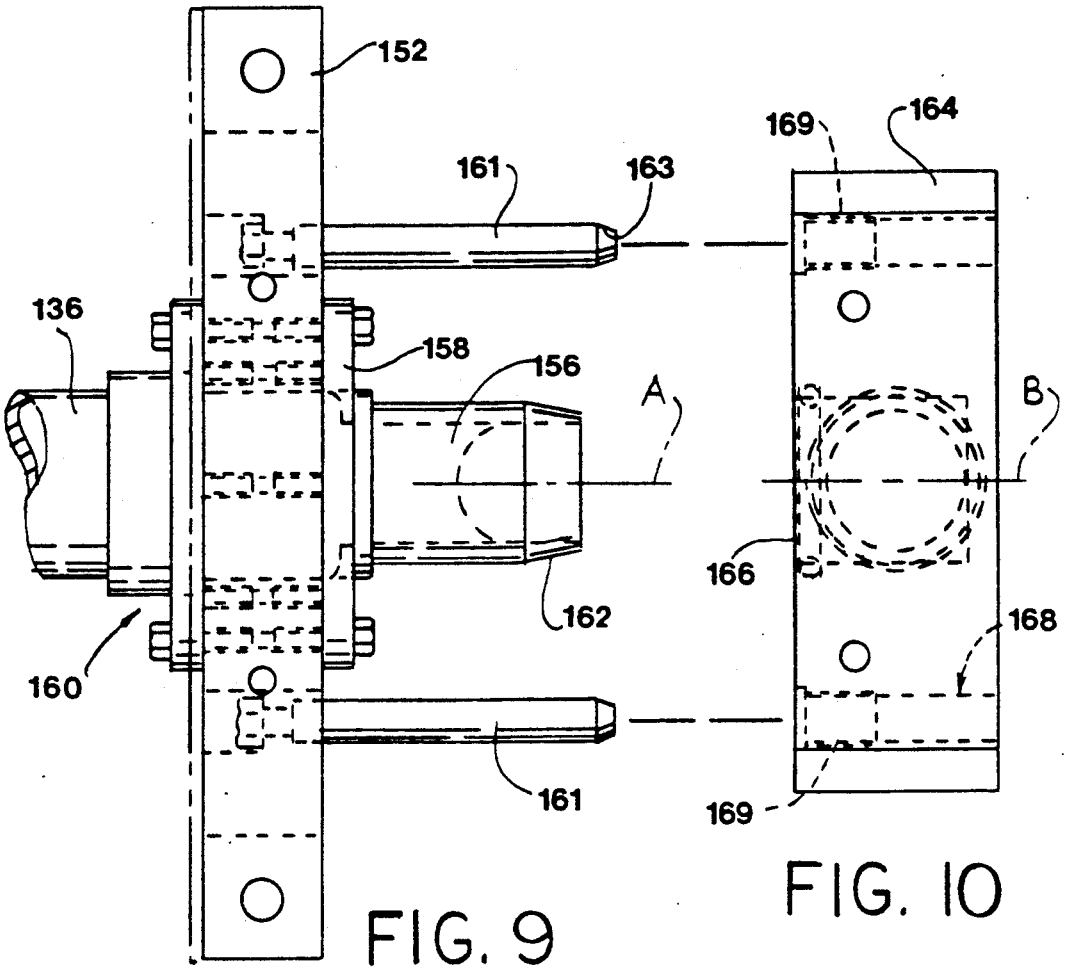
FIG. 9
FIG. 10
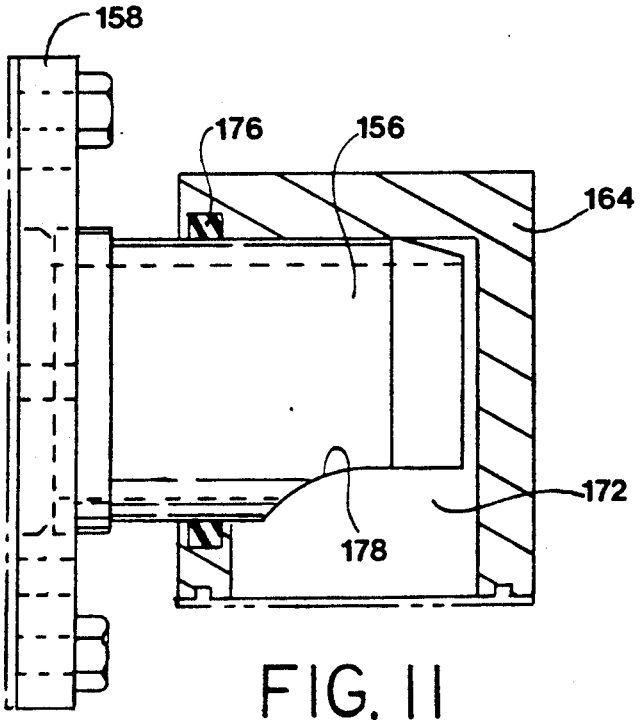
FIG. 11

CORE BLOWING MACHINE

CROSS REFERENCE TO RELATED APPLICATION

This application is a continuation-in-part of copending U.S. patent application Ser. No. 07/220,082, filed July 18, 1988 and now U.S. Pat. No. 4,942,916.

DISCLOSURE

This invention relates generally as indicated to a foundry core blowing machine and more particularly to a vertical horizontally parted cope and drag core blowing machine which achieves a high degree of precision or accuracy in the cores formed and which requires less subsequent handling, inspection or treatment, not only of the cores formed, but also the casting made.

BACKGROUND OF THE INVENTION

Foundry core blowing machines usually employ a single (one or a set of) clamp piston-cylinder assembly for assembling the cope and drag parts of the core box and for clamping the core box against the blow head and subsequently the cure or gassing head. Between the blow and cure, the box is actually unclamped.

Because of the blow operation the abutting core box parts (cope and drag) include a face seal. The seal exerts a force tending to separate the box parts. Also the blow operation creates what is known as "rebound" which again tends to open the cope and drag. When the sand resin mix is blown into the box it tends to be chilled by the blow operation. However, when it warms subsequently it tends to expand, again tending to open the box.

A box even slightly open at the parting line prior to cure creates on the core what is known as a fin. Initially only one or two grains of sand may get between the box parts at the parting line. However, the sand stays and as the machine cycle continues more and more sand enters between the box parts and the fin gets larger and larger with each subsequent core.

Finning results in loss of dimensional stability of the core and will eventually alter the dimension of the core to be out of spec. In fact, because of the problem core specifications are notoriously wide. Moreover, the sand abrades the edges of the tooling and creates excessive parting line wear. This in turn requires frequent repair or rebuilding of very expensive tooling. The problem also tends to necessitate frequent cleaning and inspection of the tooling during the operation of the machine which results in a slowing of the machine cycle or production rate. Additionally, finning also causes subsequent inspection, modification or cleaning of the core itself, or even the casting made, all of which is extremely labor intensive.

Another problem plaguing conventional core blowing machines is the retooling process. A complete tooling set for a given core may require a different cope, drag, gassing head and blow plate for each core or part formed. Tooling sets may be pre-assembled and stored on tooling conveyors adjacent the machine and the machine itself removes the tooling or repositions the new tooling in the machine. Many such machines are touted as having quick change tooling capability. However they seldom do.

The problem plaguing conventional core blowing machines is that the retooling process and subsequent processes often require the intervention or assistance of a technician, such as to remove and subsequently attach the gas supply line to the gassing head. This also slows the machine cycle and may pose a risk of injury since the functions to be performed by the technician may often be performed only at or near the top of the machine.

The problems associated with finning and tooling changes are an anathema both to automation and accuracy. It would therefore be desirable to provide a high capacity automated and efficient machine which would minimize the finning problem. While it is desirable to reduce finning, it is also desirable to provide a fully automated machine which runs more continuously without tooling changes, but when such changes are required provides automatic quick change of tooling.

SUMMARY OF THE INVENTION

A foundry core blowing machine includes an upright frame with a blow head for a sand-resin mix fixed at the top. Sectionalized vertically movable rods extend through bushings at the top and bottom of the frame. Fixed to the rods are a cope support and a secondary table. The secondary table supports the cylinder of a cope-drag clamp piston-cylinder assembly with the rod of such assembly being connected to a primary table thereabove which slidably moves on the rods. The secondary table and the rods secured thereto are elevated independently of the cope-drag clamp so that the clamped cope and drag may be elevated to be clamped against the blow head, lowered for interposition of a gassing head, and reclamped for cure, all while the cope and drag remain firmly clamped together. Only after curing are the cope and drag unclamped for lowering, stripping and removal of the core from the machine. The continuous high pressure clamp of the drag to the cope during blow and subsequent cure, even though the assembly is unclamped from the blow head prevents sand from entering between the abutting surfaces of the cope and drag and the forming of finning. The rods are formed in sections with the center section being readily replaced with rods of different height to control the shut height or window of the machine.

The machine includes a removable blow plate and a shuttling gassing head. Both the blow plate and cope may quickly be secured to and released from the machine, so that tooling sets, even including the gassing head, may be assembled on a power operated tooling change conveyor and quickly assembled into and out of the machine upon vertical movement of the primary and secondary tables, each with a single cycle of the machine. The machine may also include a shuttling curing gas supply nozzle for automated connection/disconnection with the shuttling gassing head during tooling cycles. In this manner the assistance of a technician usually with a ladder is not required to connect or disconnect fluid lines.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

BRIEF DESCRIPTION OF THE DRAWINGS

FIG. 9 is an enlarged illustration of the bayonet yoke and nozzle;

FIG. 10 is an enlarged illustration of the gassing head manifold;

FIG. 11 is an enlarged sectional view of the engaged nozzle and gassing head manifold.

DETAILED DESCRIPTION OF THE PREFERRED EMBODIMENTS

Figure 1:
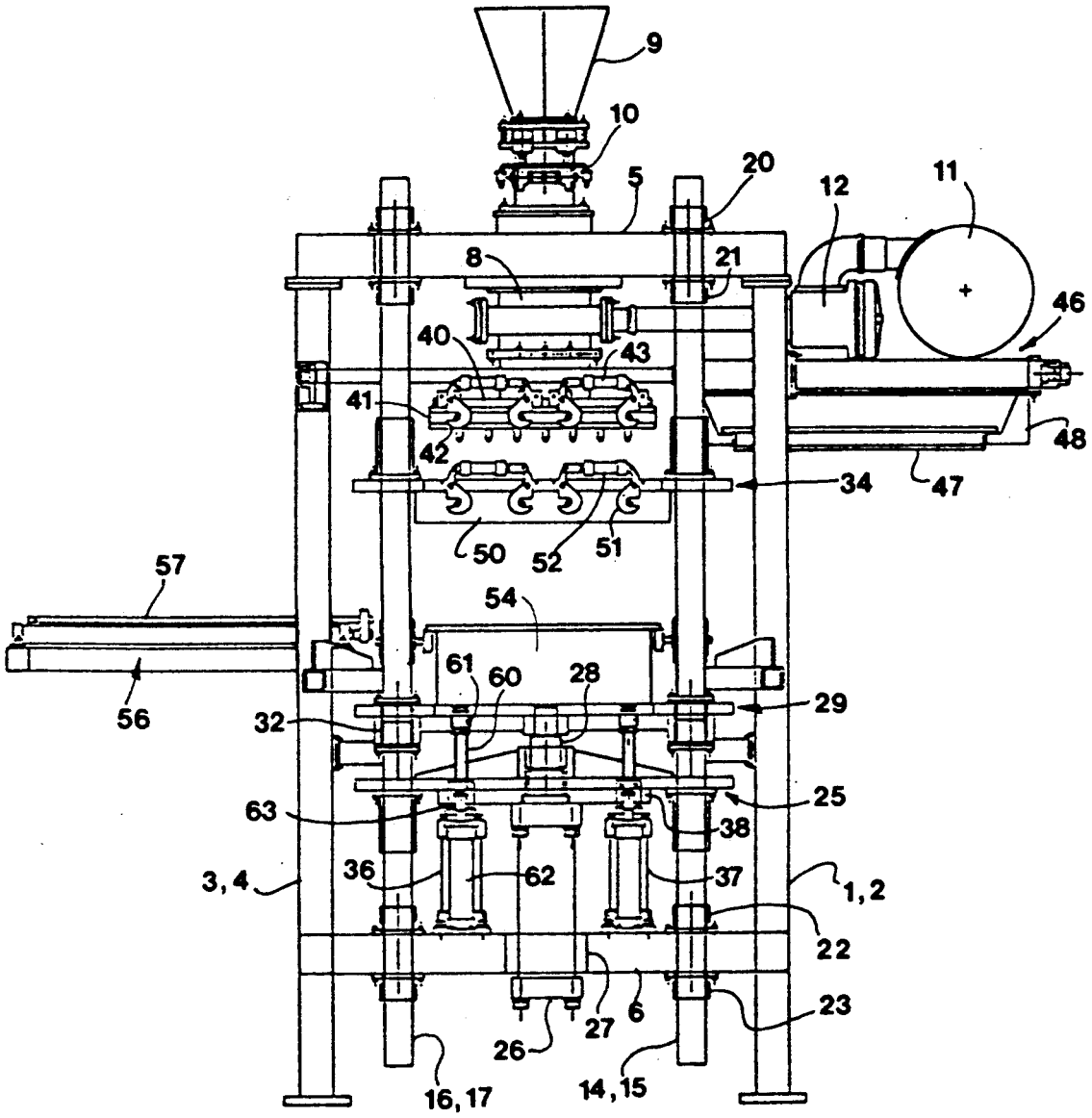
FIG. 1 is an elevation of a machine in accordance with the present invention.
Figure 2:
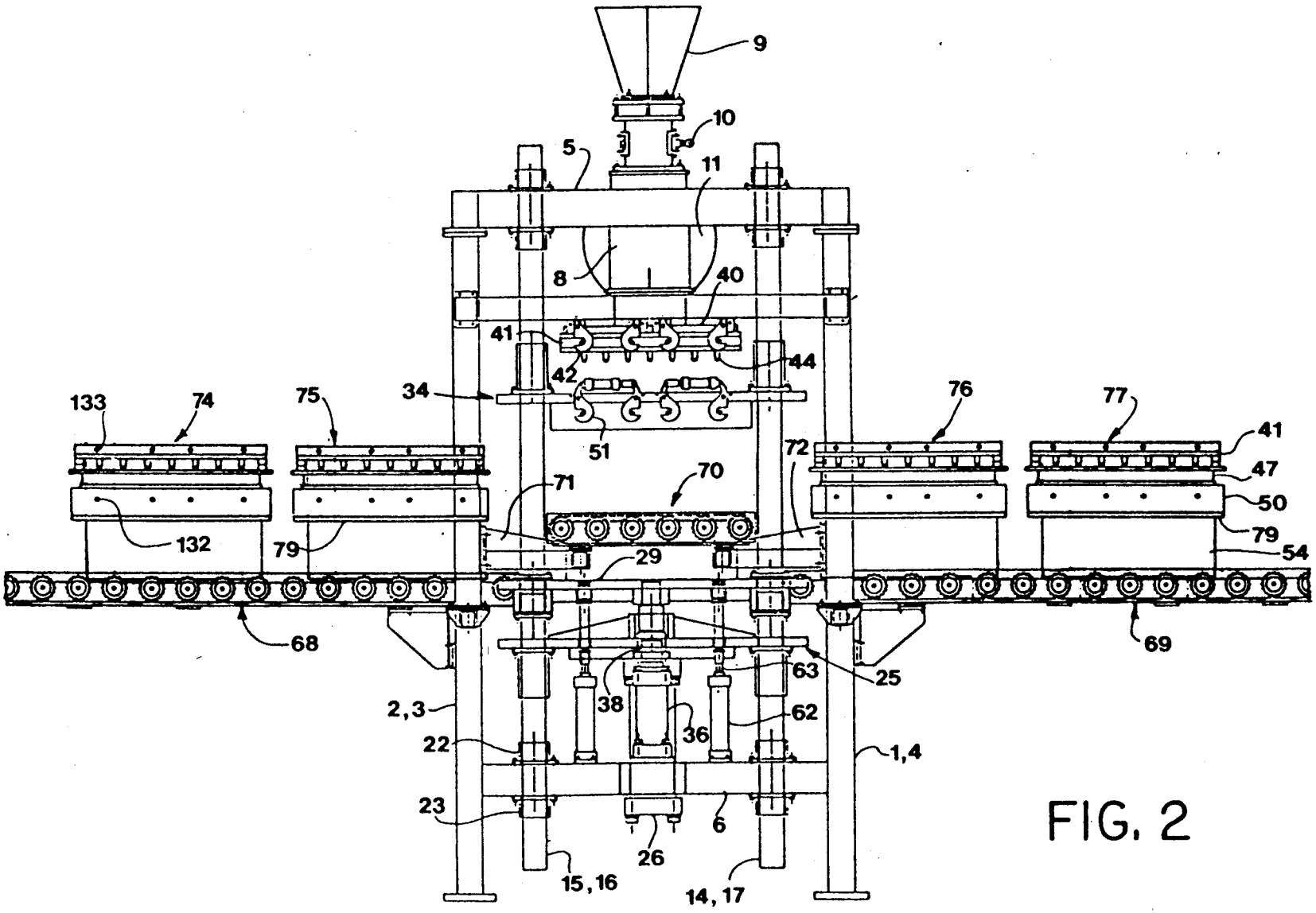
FIG. 2 is an elevation of the machine as seen from the side of FIG. 1 on a somewhat reduced scale and illustrating the tooling change conveyors.

Referring first to FIGS. 1 and 2 there is illustrated a vertical core blowing machine which includes an upright frame having four corner columns seen at 1, 2, 3 and 4. The columns are in interconnected at the top by a top frame 5 and near the bottom by a horizontal frame 6.

The upper frame 5 supports a sand-resin mix reservoir 8 which is filled from chute 9 through valve 10. Also supported by the upper portion of the frame is a reservoir 11 and a blow valve 12.

Mounted for vertical movement in the top and bottom frames 5 and 6, respectively, are four rod assemblies 14, 15, 16 and 17. Each rod assembly is mounted in linear bushings as seen at 20 and 21 in the top frame and at 22 and 23 in the bottom frame. Thus each of the four rods may move up and down with respect to the fixed frames 5 and 6. Secured to the rod assemblies for movement therewith is a secondary table shown generally at 25. Secured to the underside of the center of the secondary table 25 is the cylinder of large hydraulic piston-cylinder assembly 26. The cylinder of such assembly projects downwardly through clearance hole 27 in the bottom frame 6 and the rod 28 of such assembly projects upwardly through the secondary table and is secured to the underside of primary table 29.

Unlike the secondary table, the primary table 29 is mounted for movement along the rod assemblies 14–17, being supported thereon by bushings indicated at 32 for each rod assembly.

Positioned above the primary table 29 is a cope mounting plate 34 which is fixed to the rod assemblies 14–17.

Positioned on top of the lower frame 6 are two hydraulic piston-cylinder assemblies 36 and 37. The blind end of each cylinder of such assemblies is fastened to the top of the bottom frame 6 on each side of the larger piston-cylinder assembly 26 and the rods of such piston-cylinder assemblies 36 and 37 indicated at 38 are connected to the underside of the secondary table 25. When the piston-cylinder assemblies 36 and 37 extend the secondary table moves upwardly and of course with it also moves the larger piston-cylinder assembly 26 and each of the rod assemblies 14–17. With the rod assemblies, the cope mounting plate 34 also moves since the cope mounting plate is, like the secondary table, fixed to the rod assemblies.

The lower end of the sand-resin mix reservoir 8 includes horizontal plate 40 to which is releasably clamped blow head 41 by means of the pivoting paired hook-shaped clamps 42 with each pair being pivoted in opposite directions by piston-cylinder assemblies 43. The blow head may include a series of downwardly projecting nozzles 44, the arrangement and length of which depend upon the particular core or set of cores being blown.

Extending laterally of the machine frame is a horizontally extending shuttle shown generally at 46 which supports a gassing head 47 on brackets 48. As will be appreciated, the gassing head is an open bottom frame or hood, again which may vary in dimension and depth. The gassing head is normally connected to a source of gas such as an amine gas which is a catalyst for the two-part resin in the conventional cold box process. In any event with the shuttle the gassing head 47 may be shuttled horizontally to the position beneath the blow head 41 when there is suitable clearance in the cycle of the machine.

The cope 50 or upper portion of the core box is clamped to the underside of the cope mounting plate 34 by similar paired hook shaped clamps 51 which are actuated by piston-cylinder assemblies 52.

The drag 54 or lower portion of the core box is supported directly on the primary table 29.

As seen in FIG. 1 extending on the opposite side of the frame as the gassing head shuttle 46 is a picker assembly 56 which shuttles picker fingers 57 horizontally into and out of the machine at an appropriate point in the cycle through the actuation of a long stroke piston cylinder assembly.

Also as seen in FIG. 1 there are four strip pins 60 mounted in bushings 61 on the primary table 29. Aligned with each strip pin is a strip piston-cylinder assembly as indicated at 62. Such strip piston-cylinder assemblies are mounted on the bottom horizontal frame 60 and the rods or strip pistons 63 thereof are shown retracted in FIGS. 1 and 2. The strip pins and strip rods of the strip piston-cylinder assemblies pass through clearance holes in the secondary table 25.

The tooling for the machine consists primarily of the cope and drag but if different cores are to be blown, the changing of the cope and drag may also require changing of the blow head 41 as well as the gassing head 47. Thus a complete tooling set would include the drag 54, the cope 50, the gassing head 47 and the blow head 41, although not each of the components may require changing for different cores.

As seen in FIG. 2 the machine may include horizontally extending powered conveyor sections 68 and 69 on each side of the machine as well as a center conveyor section 70 at a somewhat higher elevation such section being supported on brackets 71 and 72 from the frame columns. As illustrated there are two tooling sets on each side of the machine frame as seen at 74, 75, 76 and 77 and each tooling set includes a drag 54, the cope 50, a gassing head 47 and blow head 41, stacked one on top of the other in that order. Each of the components of the tooling set may be provided with guide pins and bushings in conventional manner to maintain the tooling components in proper vertical alignment. The cope 50 as well as the blow head 41 are provided with laterally projecting pins as seen at 132 and 133, respectively. These pins and the hook-shape clamps 42 and 51 may be provided on two parallel sides of the tooling or on all four sides, as illustrated.

The drag 54 is provided with an upper flange indicated at 79 in FIG. 2 so that as a tooling set is transferred into the machine, the weight of the tooling set will be transferred from the bottom of the drag on the conveyors 68 or 69 to the flange 79 on the conveyor 70, the top of the latter being substantially horizontally aligned with such flange.

The conveyors 68 and 69 may be of substantial length, and, for example, up to five tooling sets may be provided on each conveyor. This enables the quick change of tooling as hereinafter described and also enables a tooling set readily to be removed from the machine and replaced by another, even if identical, so that a tooling set may be properly serviced or cleaned outside of the machine as production continues.

Figure 3:
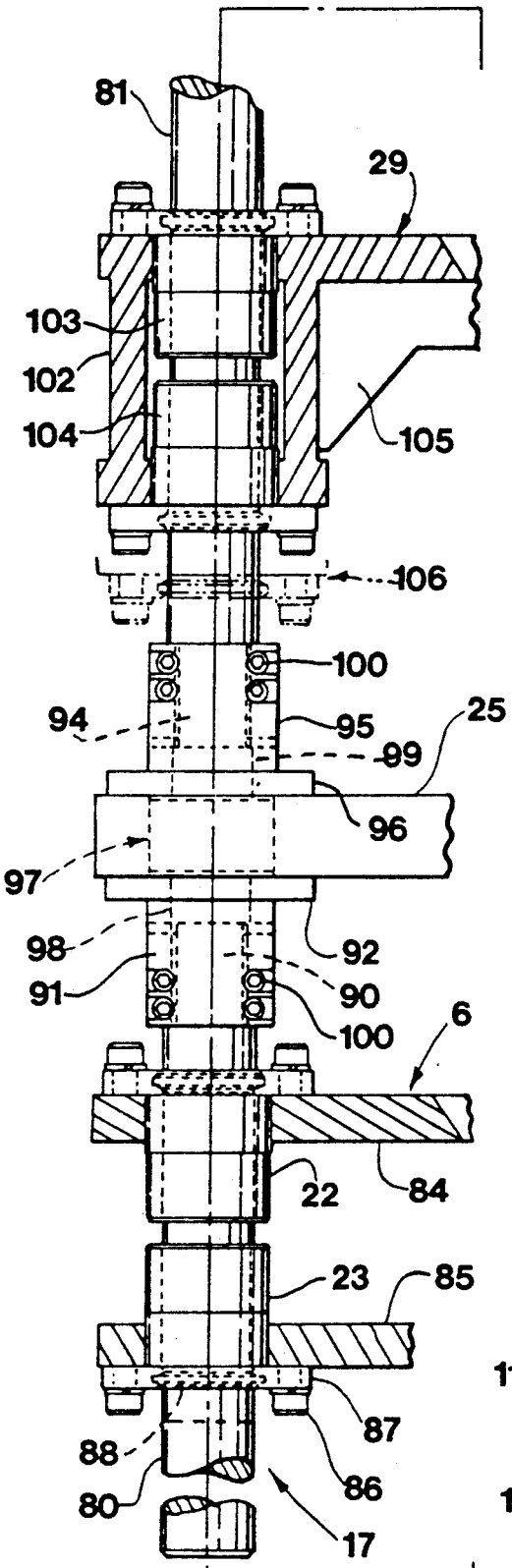
FIG. 3 is an enlarged broken elevation of the lower portion of a rod assembly.
Figure 4:
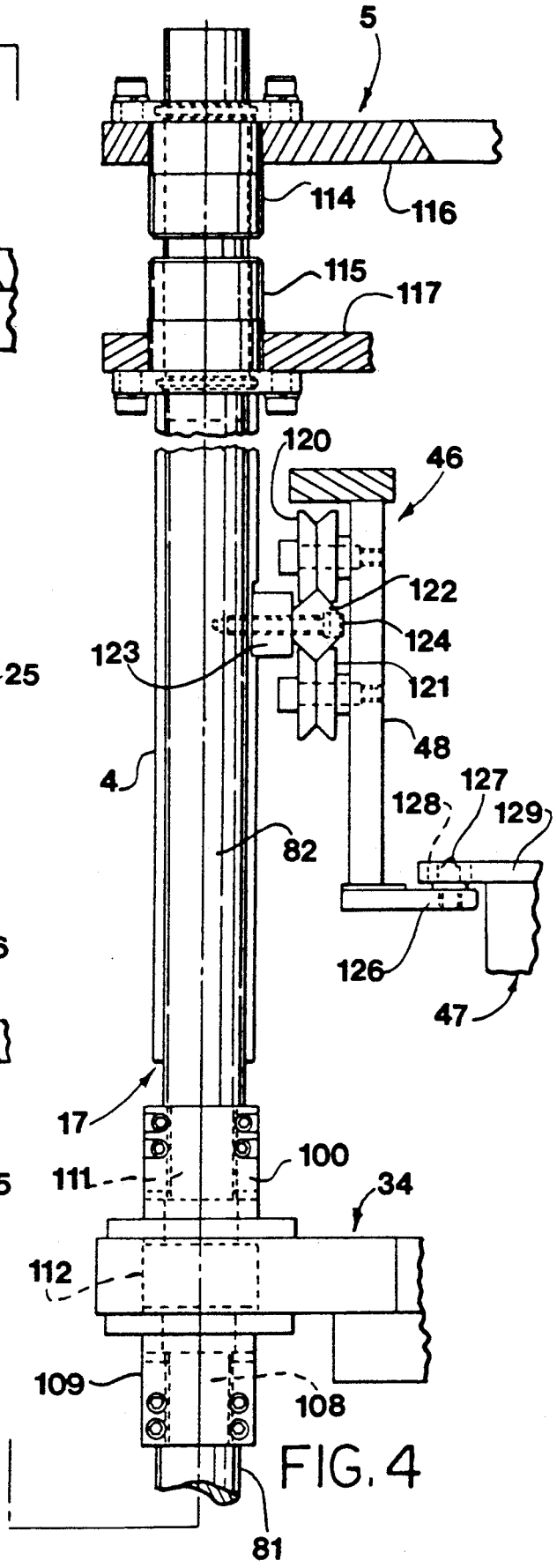
FIG. 4 is a broken continuation of FIG. 3 showing the upper portion of the rod assembly.

Referring now to FIGS. 3 and 4 there is illustrated in more detail a vertical rod assembly and the various components either fixed to the rod assembly or slidable with respect thereto. The rod assembly 17 illustrated in FIGS. 3 and 4 actually comprises three separate rod sections, namely: lower rod section 80; middle rod section 81; and upper rod section 82. The lower rod section 80 as seen in FIG. 3 extends through parallel plates 84 and 85 which are included in the bottom frame 6. As indicated, the rod section 80 passes through bushings 22 and 23 which may be in either the inverted position seen in FIG. 3 or in the projecting position seen in FIGS. 1 and 2. The bushings are held to the parallel plates by fasteners 86 extending through the bushing flanges 87. Also, as indicated, each bushing includes a readily replaceable rod wiper.

The upper end of the lower rod section 80 is threaded as indicated at 90 and such threads engage the internal threads on split sleeve 91 which is provided with a flange 92 secured to secondary table 25.

The lower end of intermediate rod section 81 is provided with a threaded end 94 in similar fashion engaging internal threads on split sleeve 95, the flange 96 of which is secured to the top of secondary table 25. Proper alignment of the two sections is obtained by a shouldered dowel or pilot pin 97 which has reduced diameter end projections 98 and 99 fitting in the flanged ends of the split sleeves 91 and 95, respectively. As illustrated, the fasteners 100 may be employed to draw the split end of the sleeves tightly toward each other.

As illustrated at the top of FIG. 3 the primary table 29 may be provided with corner hubs 102 through which the rod section 81 extends with bushings 103 and 104 being fastened to the ends of the hub in the same manner as the bushings 22 and 23 are fastened to the respective plates 84 and 85 seen at the bottom of FIG. 3. As illustrated, the primary table may be reinforced as seen at 105 and the axial length of the hub 102 may vary as indicated by the phantom line position 106.

Turning now to FIG. 4 the upper end of the middle or intermediate rod section 81 is threaded as indicated at 108 and secured to internally threaded split sleeve 109 in turn secured to cope mounting plate 34. Secured to the top of the cope mounting plate is a split sleeve 110 which engages the threaded lower end 111 of the top rod section 82. Again a shouldered dowell 112 is employed for alignment purposes. The upper rod section extends through bushings 114 and 115 secured to parallel plates 116 and 117, respectively, which may form the top frame 5.

It can thus be seen that the rod assembly slides up and down with respect to the bottom frame 6, is secured or fixed to the secondary table 25, slides with respect to the primary table 29, is fixed to the cope mounting plate 34 and slides with respect to the top frame 5. The intermediate or center section 81 of the rod assembly extends from the secondary table 25 to the cope mounting plate 34 and the length of this rod section controls the shut-height or window of the machine. This window may be altered by replacing the rod section 81 with rod sections of different length.

FIG. 4 also illustrates the gassing head or frame shuttle 46 which is in the form of a carriage which includes upper and lower V-rollers 120 and 121 riding on diamond shaped rails 122 which are secured through spacer 123 by fasteners 124 to the interior of fixed frame column 4. Horizontal movement of the shuttle 46 along the rails 122 is accomplished by the shuttle cylinder which is a long stroke piston cylinder assembly.

As illustrated, the bracket 48 includes an inwardly directed bottom arm 126 which includes an upwardly directed pilot pin 127 fitting within bushing 128 in the top flange 129 of the gassing head 47. There are of course four such brackets, pins and bushings supporting the gassing head for such shuttling movement. The gassing head can of course be lifted off of the pins and when so lifted will clear the top of the pins.

Figure 5:
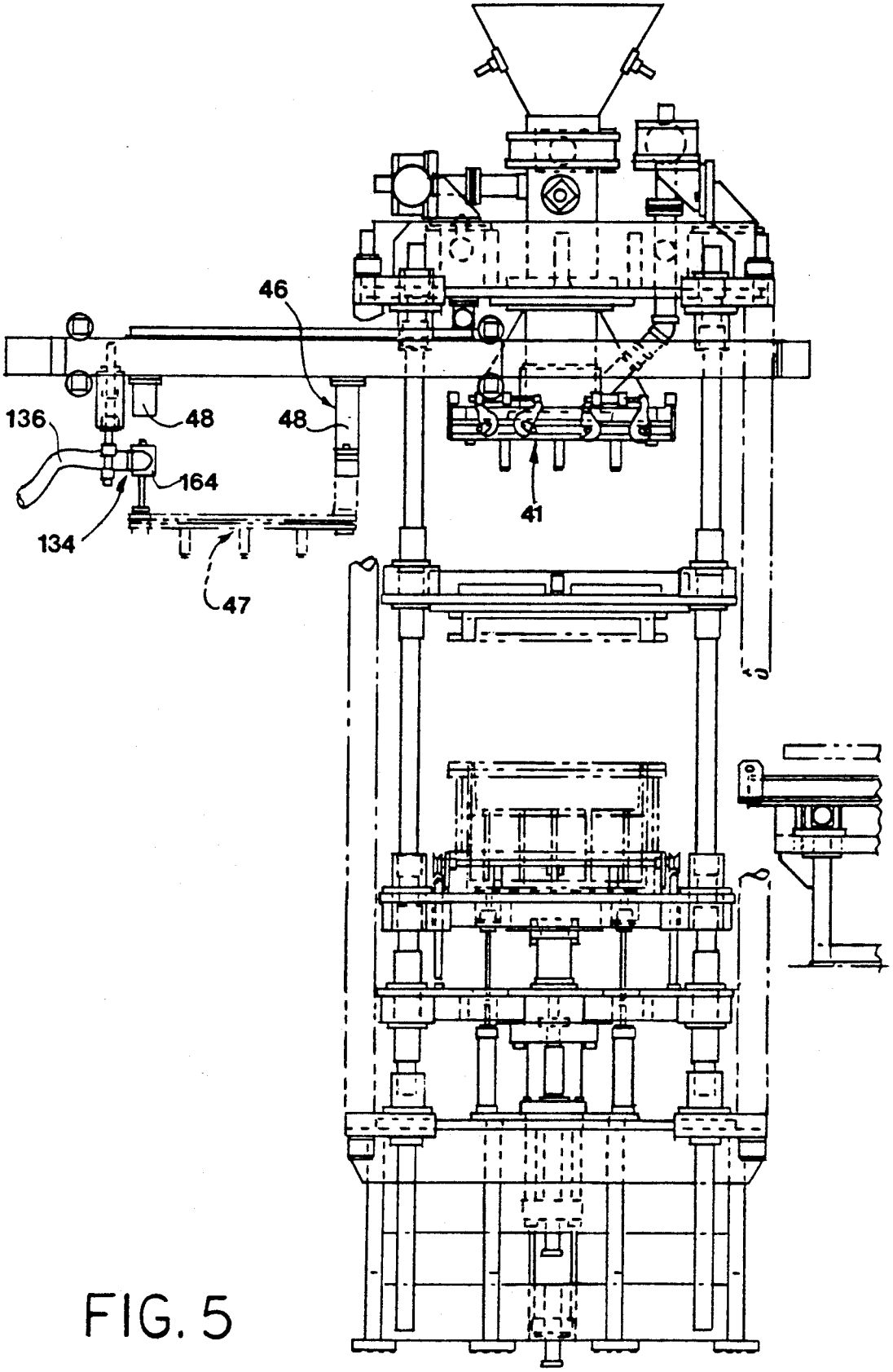
FIG. 5 is an elevation of the machine with particular detail given to the gassing head in its shuttled position.
Figure 6:
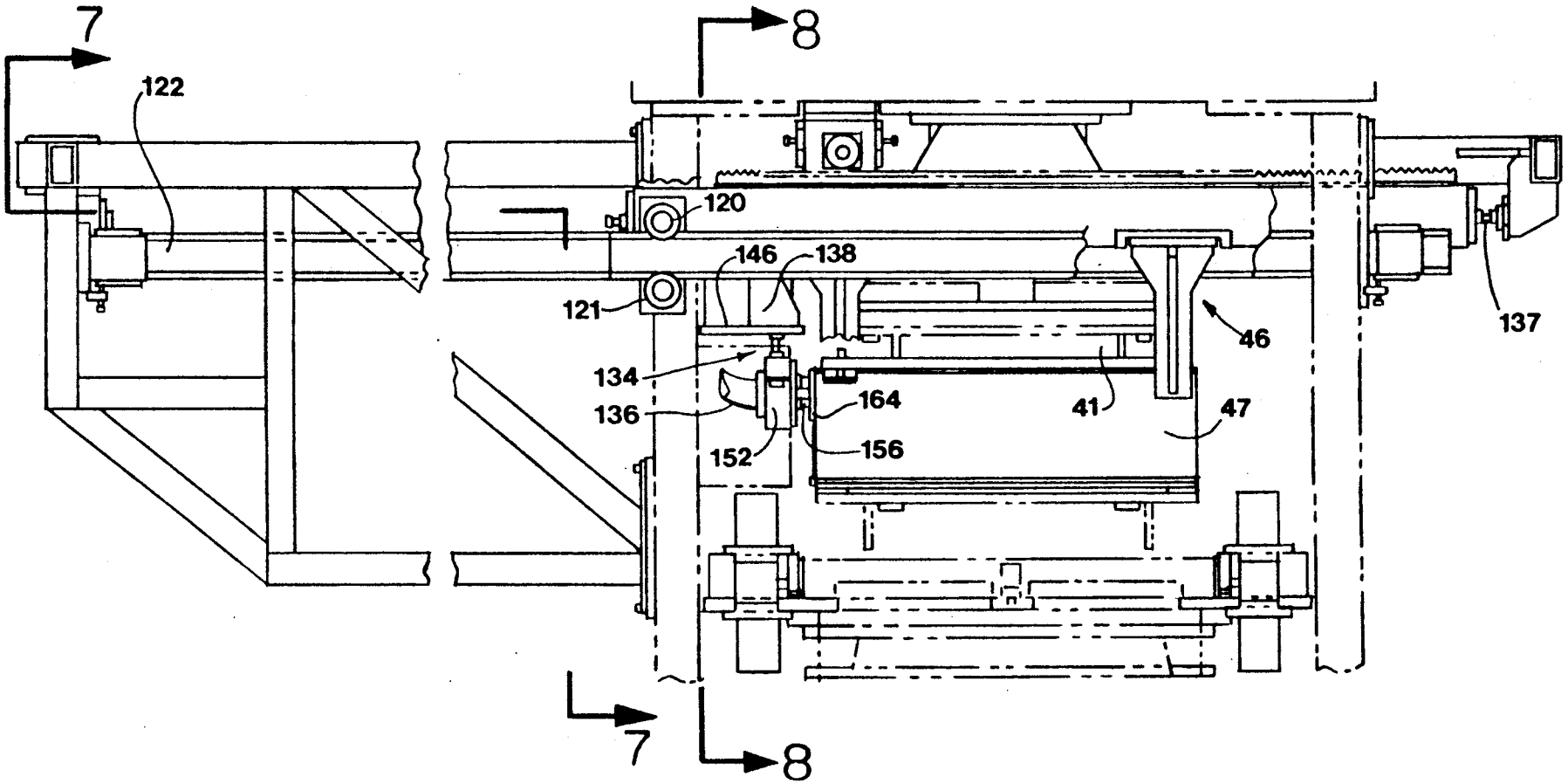
FIG. 6 is a broken close-up view of the machine with the gassing head in place in the machine.

As mentioned above, the gassing head 47 is provided with a catalyst gas, such as an amine gas, through the nozzle assembly 134 and attached flexible supply line 136 to cure the blown sand resin mix. The nozzle assembly 134 is mounted on the gassing head shuttle 46, thus permitting horizontal movement of the nozzle assembly for effecting axial connection/disconnection with gassing head 47 during retooling operations. An adjustable stop 137 controls the maximum horizontal travel of the gassing head shuttle 46 and nozzle assembly 134 toward the right hand side of the shuttle, providing for precise positioning of the gassing head shuttle and nozzle assembly for connection with the gassing head. Once connected, however, the nozzle assembly 134 and gassing head 47 move together, such as during shuttling of the gassing head in or out of a position directly below the blow head 41. FIGS. 5 and 6 show the blow head 41 and nozzle assembly 134 in their connected condition in a position fully retracted and in a position under the blow head 41, respectively.

Figure 7:
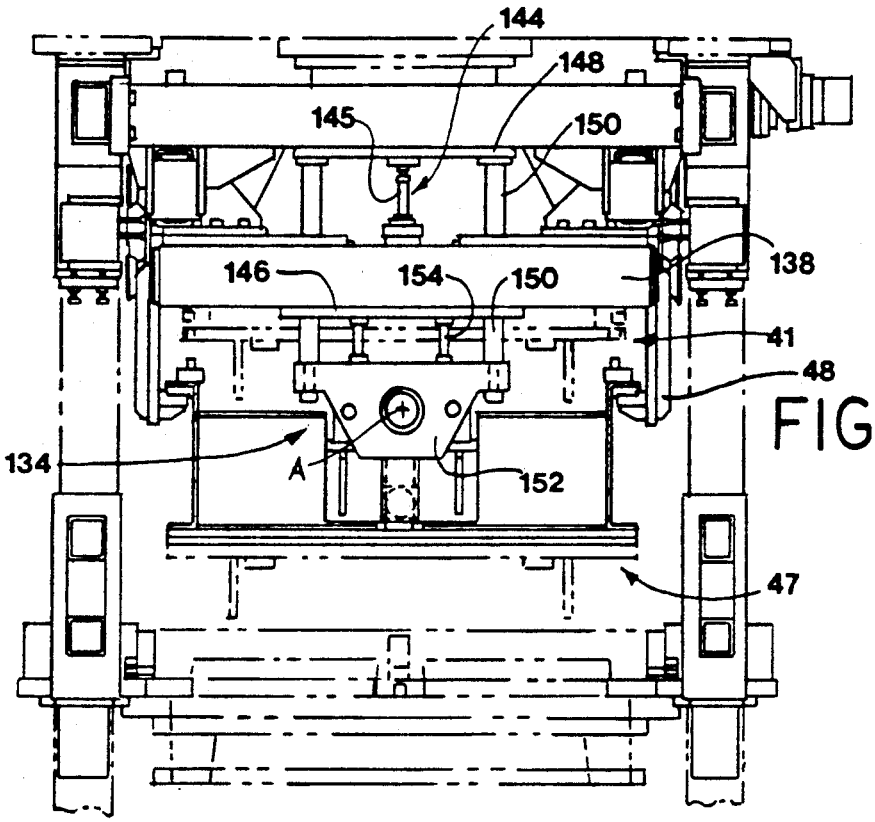
FIG. 7 is a view of the gassing head and nozzle assembly taken along the line 7—7 in FIG. 6.

As is shown most clearly in FIG. 7, the nozzle assembly 134 is movably supported from a frame element 138 of the gassing head shuttle 46 by a single acting air cylinder 144. The air cylinder 144 is mounted at its blind end to a plate 146 attached below the frame element 138 with the rod of the cylinder 144 attached to a second flat plate 148 positioned above the frame element 138. A pair of vertical cylindrical rods 150 extend downwardly from the plate 148 through the frame element 138 into securement with a bayonet yoke 152. Consequently, the flat plate 148, the vertical rods 150, and the bayonet yoke 152 form a rigid structure which moves in the vertical direction independently of the frame element 138, through actuation of the air cylinder 144. The rod end of the air cylinder 144 is vented to ambient pressure.

The blind end of the air cylinder is connected to an air supply with sufficient pressure to overcome the weight of the nozzle assembly 134 and supply hose 136 so as to permit elevation of the bayonet yoke 152. The air cylinder blind end is controllably vented to ambient through a constant pressure regulator which maintains at least a slight pressure, e.g. 15 psi, in the blind end at all times. The maximum height to which the air cylinder 144 may elevate the bayonet yoke 152 is regulated by a pair of adjustable stops 154.

A nozzle 156 having a flange 158 is attached to the bayonet yoke 152 and extends perpendicularly thereto along the axis A, as seen in FIG. 9. The flexible supply hose 136 is attached to the opposite side of the bayonet yoke 152 by the connector 160 and supplies the curing gas to the nozzle 156 through the bayonet yoke. Also extending horizontally from the bayonet yoke 152 is a pair of guide pins 161 which facilitates aligned engagement of the nozzle 156 with the gassing head 47. The nozzle 156 and guide pins 162 have chamfered distal edges 162 and 163, respectively, also facilitating connection of the nozzle assembly and gassing head. A curvilinear cutaway 178 on the lower surface of nozzle 156 increases the open exit area of the nozzle in a downward direction.

Figure 8:
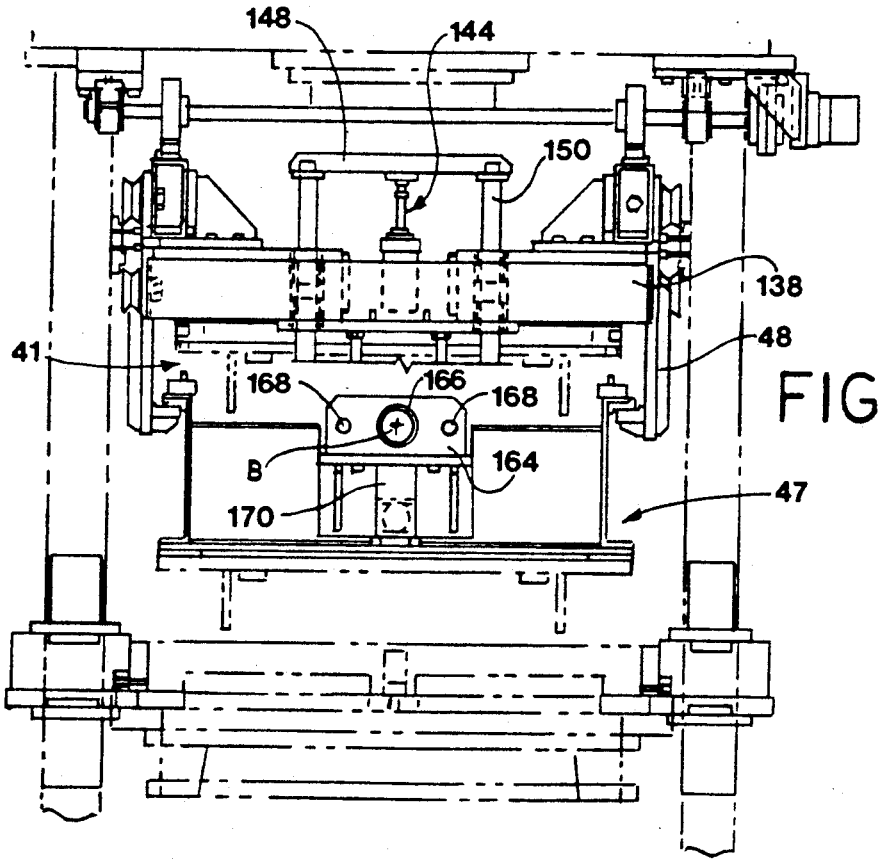
FIG. 8 is a view of the gassing head taken along the line 8—8 in FIG. 6.

As shown in FIGS. 8 and 10–11, the gassing head 47 includes a manifold 164 having an orifice 166 and a pair of guide holes 168, each having guide bushings 169. The orifice 166 extends into the manifold 164 along the axis B to such an extent as to allow adequate sealed insertion of the nozzle 156. The orifice 166 then angles down through the manifold and through an extension element 170 thus providing a passageway 172 from the manifold orifice 166 to the gassing head 47. The guide holes 168 and bushings 169 are aligned with the guide pins 161 of the bayonet yoke 152 to permit insertion of the pins therein.

Digressing briefly, it is noted that the adjustable stops 154 are adjusted, prior to placing the machine in use, so that the bayonet yoke 152 and attached nozzle 156 may be elevated to a point where the axis A passing through the yoke and nozzle is closely aligned with the axis B of the manifold 164, when the gassing head is in a fully elevated position. This permits the insertion of the nozzle 156 into the manifold orifice 166, as is shown in FIG. 11. When inserted, a sealing element 176, such as an O-ring, located on the inner surface of the manifold orifice forms a tight seal between the manifold and the inserted nozzle 156 to prevent the escape of curing gas from the passageway 172 to the ambient environment. The correct extent of insertion of the nozzle is controlled by an adjustable stop at the right hand side of the shuttle as seen in FIG. 6 at 137. The cutaway 178 of the nozzle 156 provides for unrestricted flow of the curing gas from the supply hose 136 through the nozzle 156 down through the passageway 172 to the gassing head 47.

In order to place a set of tooling into the machine, the primary and secondary table will be in the down position as seen in FIG. 2 and the hooks 42 and 51 of each pair will be opened or pivoted toward each other by extension of the piston-cylinder assemblies 43 and 52, respectively. Also, the gassing head shuttle 46 and the nozzle assembly 134 will be in the retracted position to the left or remote from the center of the machine.

With the machine thus ready to receive a tooling set, the conveyor 68 may be energized to index the tooling set 75 to the right as seen in FIG. 2 with the tooling set within the machine being supported by the conveyor section 70 engaging the drag flange 79. With the tooling set in the proper position, both tables 25 and 29 are elevated by extension of the piston-cylinder assembly 26 as well as the piston-cylinder assemblies 36 and 37. The complete elevation of the tooling set places the blow head 41 against the plate 40 and the cope 50 against the cope mounting plate 34, all in elevated position. At this point the piston-cylinder assemblies 43 and 52 are extended to cause the hooks to engage the lateral pins on the blow head and cope, respectively. It is noted that the pins are slightly inwardly offset from the hook pivots and with the configuration of the hook the blow head and cope are tightly secured to the plate 40 and cope mounting plate.

With the complete tooling set elevated, the shuttle cylinder assembly horizontally moves the gassing head shuttle 46 and attached nozzle assembly 134 toward a position in the center of the machine. Concurrently, the blind end of the single acting cylinder 144 is provided with sufficient pressure to overcome the weight of the bayonet yoke 152 and supporting structure so as to elevate the yoke and affixed nozzle 156 until the top surface of the yoke contacts the adjustable stops 154. This approximately aligns the axis A passing through the center of the nozzle 156 with the axis B passing through the center of the manifold orifice 166, with the gassing head in its fully elevated position. As the horizontal movement of the nozzle assembly continues, the chamfered surfaces 163 of the guide pins 161 will enter the guide holes 168 of the manifold 164, further centering the nozzle 156 for unhindered insertion into the manifold orifice 166 to the extent controlled by stop 137.

When the gassing head shuttle 46 and attached nozzle assembly 134 are fully shuttled into the machine, the nozzle 156 will be firmly engaged and sealed in the manifold 164 and the pilot pins 127 of the bottom arm 126 of the shuttle 46 will align with the bushings 128 of the gassing head 47. With the rod end of the cylinder 144 at ambient pressure, the pressure in the blind end of the cylinder is relieved through a constant pressure regulator until it reaches a point approximately 15 psi above ambient, where it is maintained.

The tables are now lowered toward the original down position. Since the blow head 41 is secured to the plate 40 it will remain where it is. As the remaining tooling components are lowered, the gassing head 47 will engage the gassing head shuttle 46 upon which it will rest. Since the pressure in the air cylinder 144 supporting the yoke 152 and affixed nozzle 156 has been substantially relieved, the structure will essentially float with the gassing head 47. This reduces stresses on the bayonet yoke 152 and manifold 164 to a minimum. Additionally, since a slight pressure is maintained in the blind end of the cylinder 144, the full weight of the yoke 152, nozzle 156, supply hose 136 and related structure does not rest completely on the manifold 164, but rather is partly supported by the shuttle 46. This also keeps stresses to a minimum in the connected assemblies.

Continued lowering of the tables lowers the cope and drag down to the position seen in FIG. 1. The gassing head and attached nozzle assembly 134 is then retracted to a position remote from the center of the machine, as shown in FIG. 5. At this point the machine is ready to commence operation.

To remove a tooling set from the machine the above described operation is simply reversed. The gassing head is simply shuttled in and the tooling parts are clamped together by elevation of the tables. The gassing head shuttle is then withdrawn causing the nozzle 156 to disengage the manifold orifice 164 as the nozzle assembly 134 is shuttled away with the gassing head shuttle. The hook-shape clamps are opened, and the lowering of the table simply places the assembled tooling set on the conveyor section 70 for removal either left or right, as seen in FIG. 2, from the machine. In this manner the tooling sets may very quickly be removed, replaced, or changed, either to permit production of different cores, or to permit alternately usable tooling to be cleaned and serviced outside of the machine. The need for an operator to connect or disconnect the curing gas supply to the gassing head is also eliminated, as it is now an automated process. This is a significant advance over many conventional machines which require an operator to climb a ladder each time that the gassing head is to be connected or disconnected from the curing gas supply; a time consuming and possibly dangerous task.

OPERATION

From the initial start up position seen in FIG. 1 the first step in the cycle is to extend the center clamp piston-cylinder assembly 26. This in turn elevates the primary table 29 to clamp the drag 54 against the cope under high pressure. The primary table 29 simply slides along the rod assemblies 14–17 and since the secondary table, to which the piston-cylinder assembly 26 is secured and the cope mounting plate 34 are fixed to the rod, clamping pressure of the drag to the cope to form the core box is achieved without yet any vertical movement of the rod assemblies 14–17.

Figure 13:
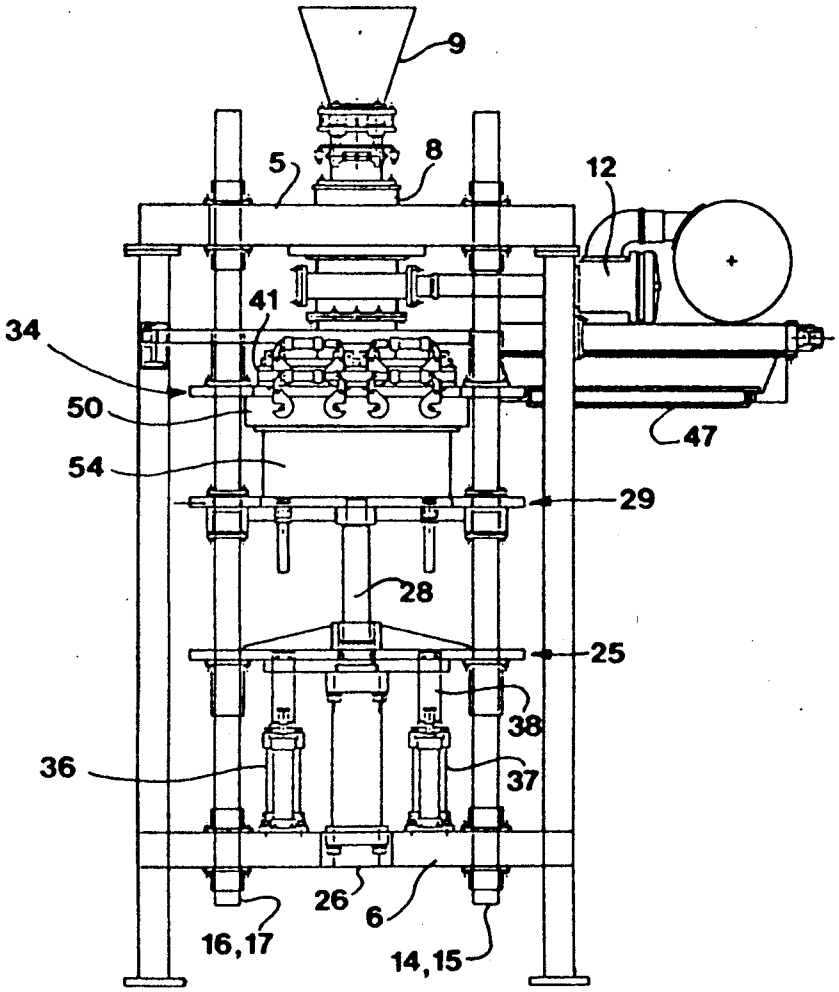
FIGS. 12–21 are elevations of the machine on a reduced scale illustrating the positions of the components of the machine during a typical cycle of operation.

As seen in FIG. 13, after the core box is formed and firmly clamped, the piston-cylinder assemblies 36 and 37 are then extended to raise the drag/cope (core box) to be clamped against the blow head 41. Since the rods 38 of the piston-cylinder assemblies 36 and 37 are connected to the secondary table which is in turn fixed to the rod assemblies 14–17, the entire assembly elevates including the clamped cope and drag which is in turn then clamped against the blow head. The high pressure clamp of the drag to the cope is maintained. In the position of FIG. 13 the blow valve is opened and the sand-resin mix is blown into the core box.

Figure 12:
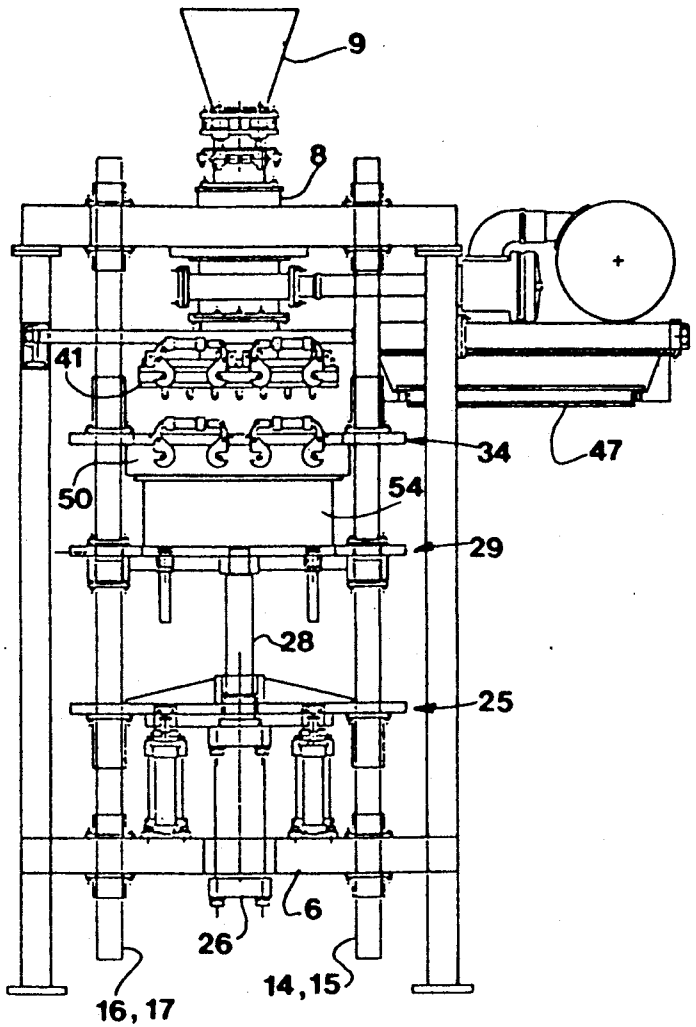
Figure 14:
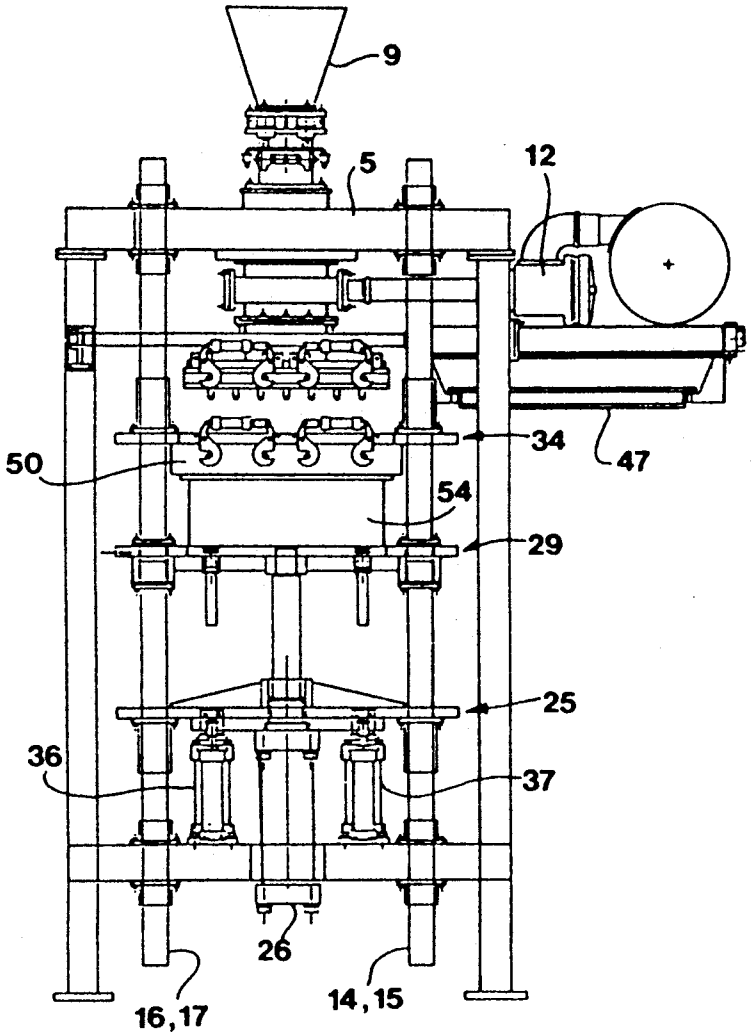

Referring now to FIG. 14 following the blow operation piston-cylinder assemblies 36 and 37 are retracted to drop the drag/cope (core box) to clear the gassing head 47 and attached nozzle assembly 134 for horizontal shuttling into the machine. In such position the parts are in the same position as in FIG. 12 only the sand-resin mix has been blown into the core box. Again, the high pressure clamp of the drag to the cope is maintained.

Figure 15:
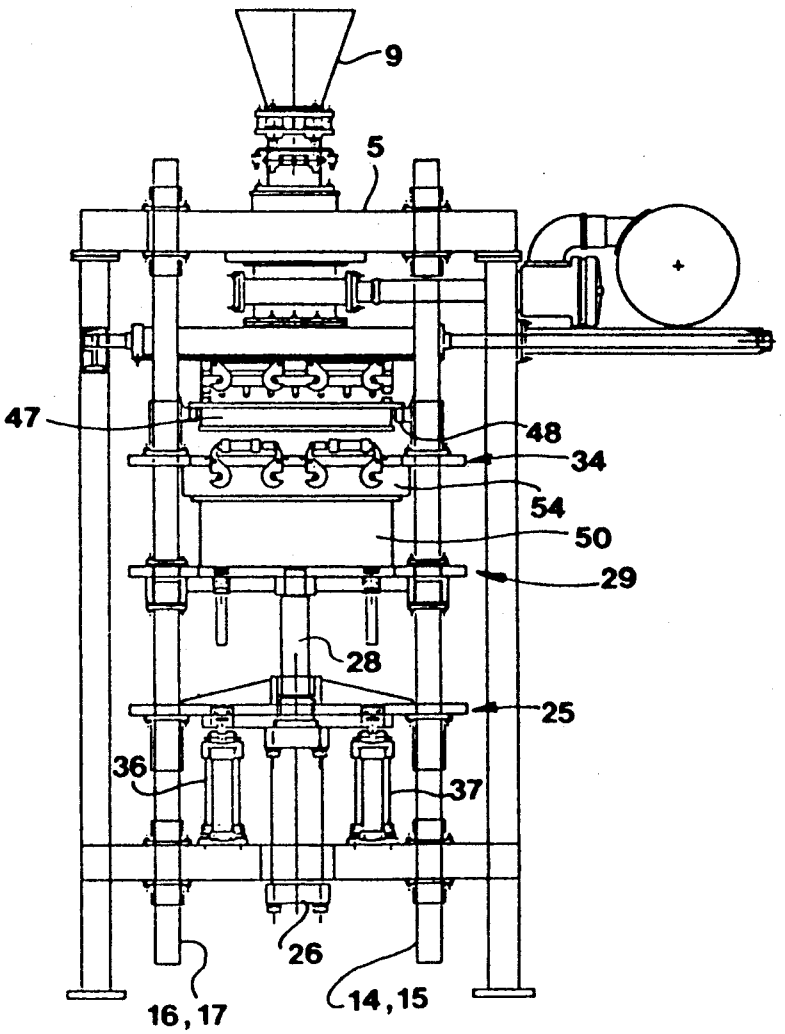

In FIG. 15 the gassing head 47 and attached nozzle assembly 134 has now horizontally been shuttled into the machine and is positioned on the brackets 48 in alignment with the core box below and the blow head above. Again the high pressure clamp of the drag to the cope is maintained.

Figure 16:
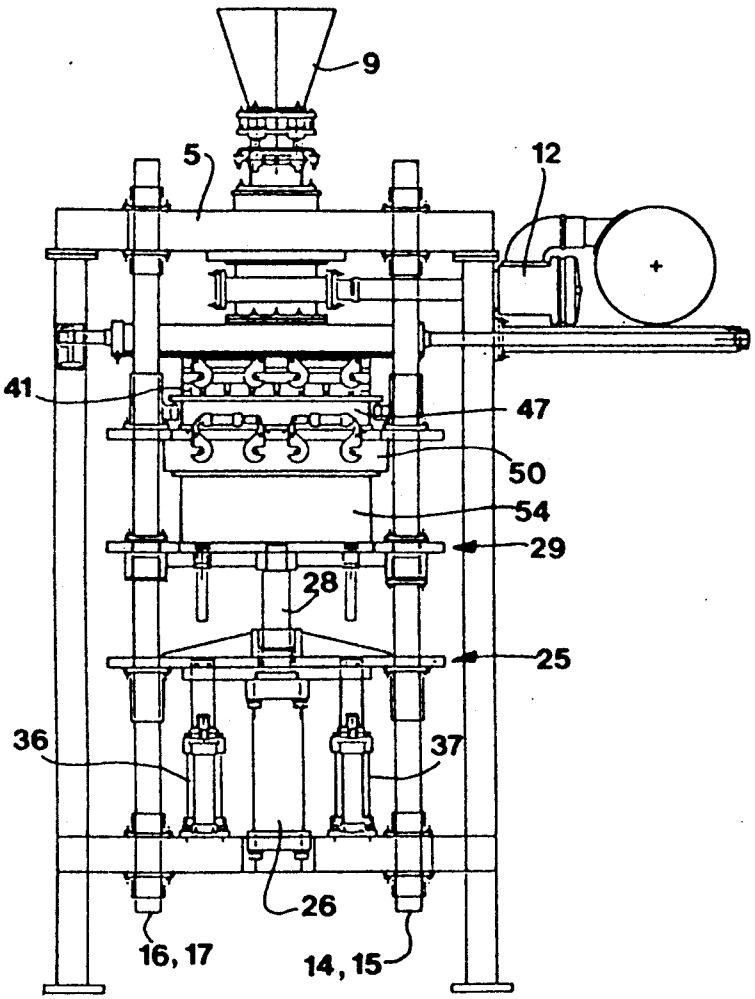

As indicated in FIG. 16 the piston-cylinder assemblies 36 and 37 are again extended elevating the drag/cope (core box) to pick up the gassing head and floating nozzle assembly and to clamp the entire assembly against the blow head 41. Again the high pressure clamp of the drag to the cope is maintained by extension of the piston-cylinder assembly 26. The core or cores as the case may be are now ready for gassing.

Figure 17:
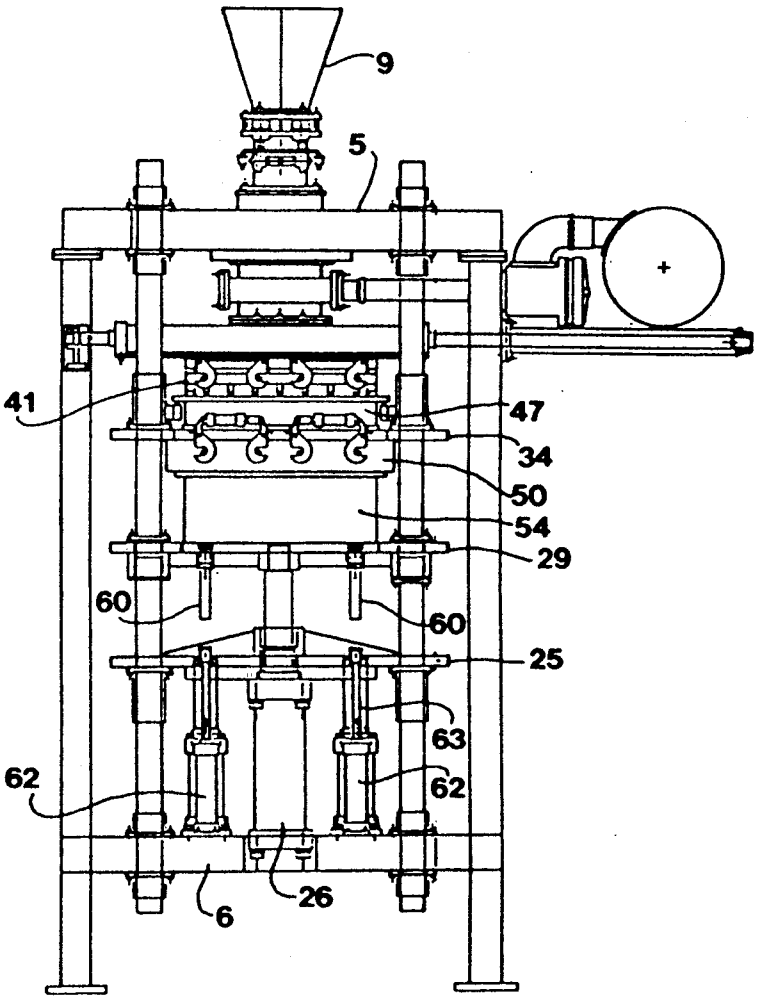

As seen in FIG. 17, while gassing takes place the rods 63 of strip piston-cylinder assemblies 62 extend. In the illustrated embodiment there are four such strip piston-cylinder assemblies 62 and as the gassing operation proceeds the strip pistons extend without the aid of flow dividers. Again the high pressure clamp of the drag to the cope is maintained by extension of the piston-cylinder assembly 26.

The gassing operation cures the sand-resin mix so that the cores harden sufficiently to be stripped from the cope and drag and to be removed from the machine.

Figure 18:
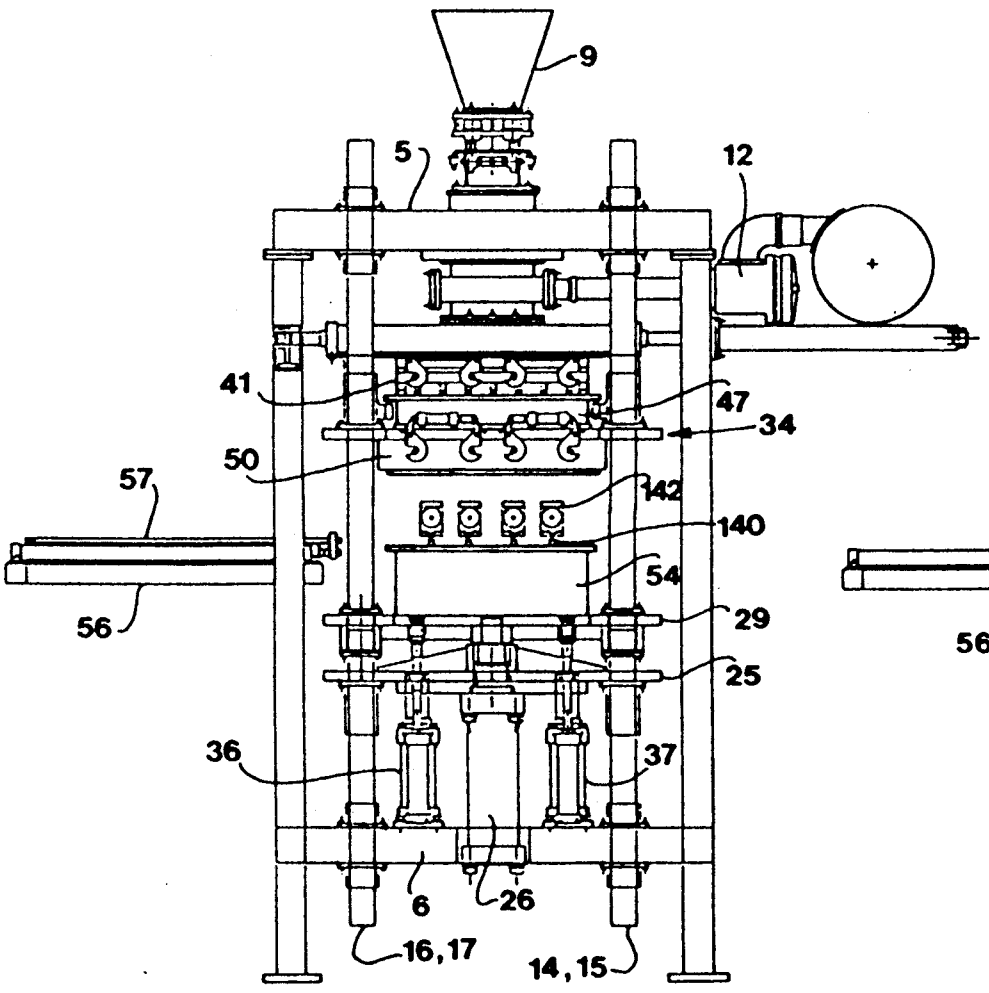

As indicated in FIG. 18 the piston-cylinder assembly 26 is initially retracted unclamping the drag from the cope stripping the cores from the cope. As the drag continues to move downwardly, the strip pins 60 engage the tops of the strip piston rods 63 holding the strip pins in position as the drag descends. The strip pins, in conventional manner, are connected to a plate in the bottom of the drag which in turn support a multiplicity of strip pins 140 supporting the cores 142 against vertical movement. Thus as the drag 54 continues down the cores 142 are held above the drag on the pins 140.

Figure 19:
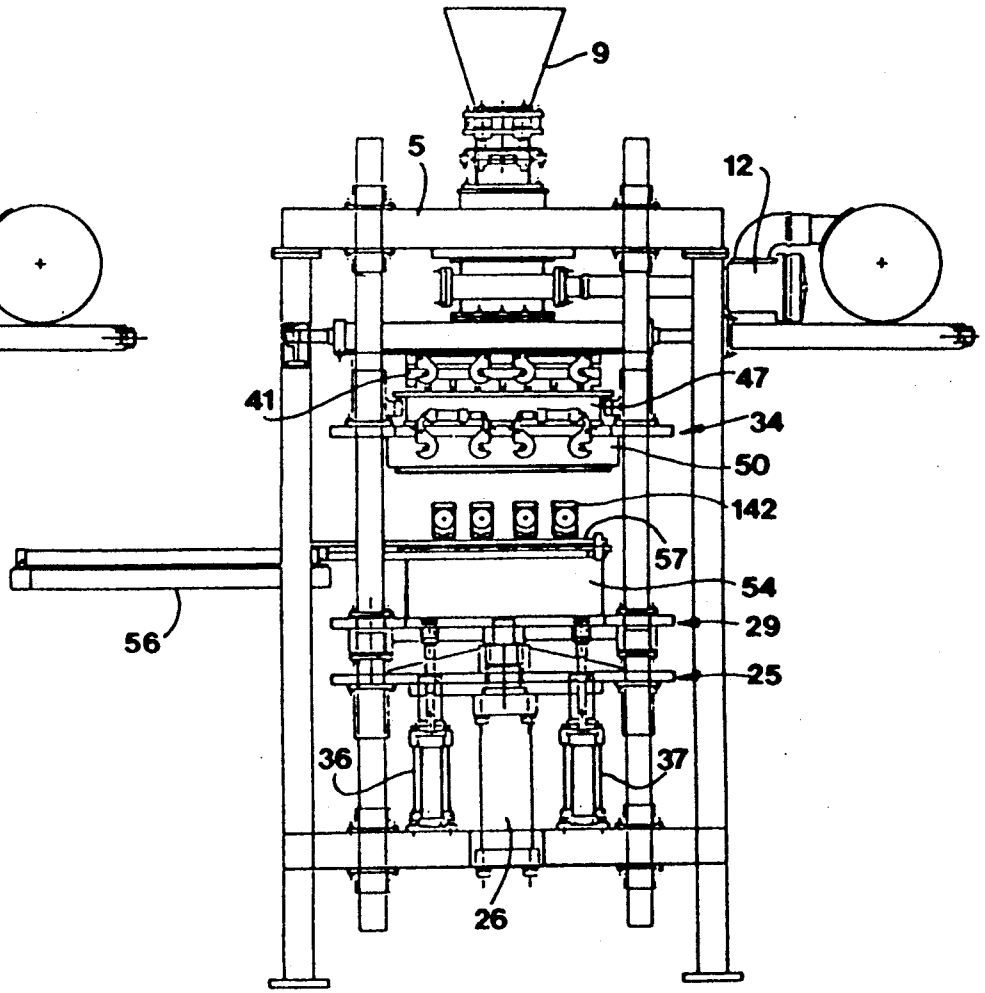

As seen in FIG. 19, with the cores held in their elevated position above the drag the picker assembly 56 is extended to shuttle the picker fingers 57 in to a position just beneath the cores 142.

Figure 20:
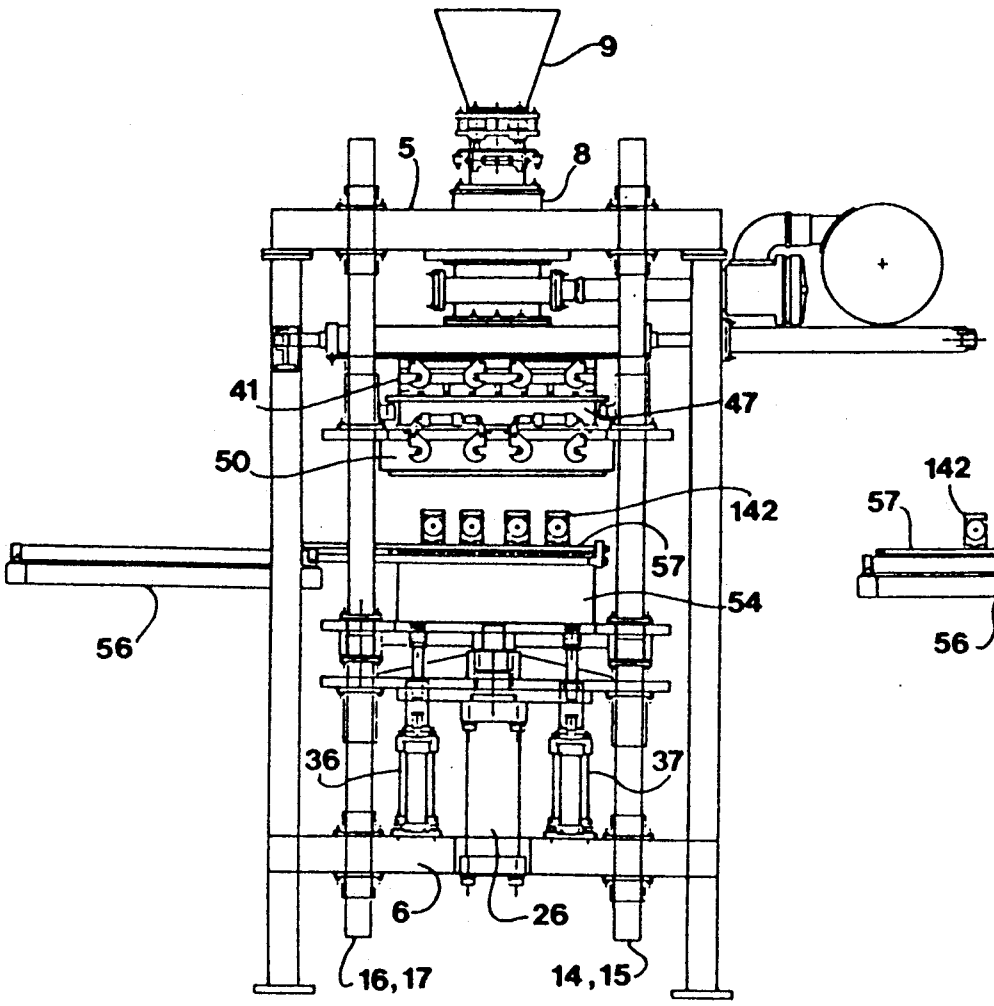

As seen in FIG. 20 the strip piston-cylinder assemblies 62 are now fully retracted which retracts the strip pins 60 and of course the pins 140 to set the cores 142 the short distance on the picker fingers 57.

Figure 21:
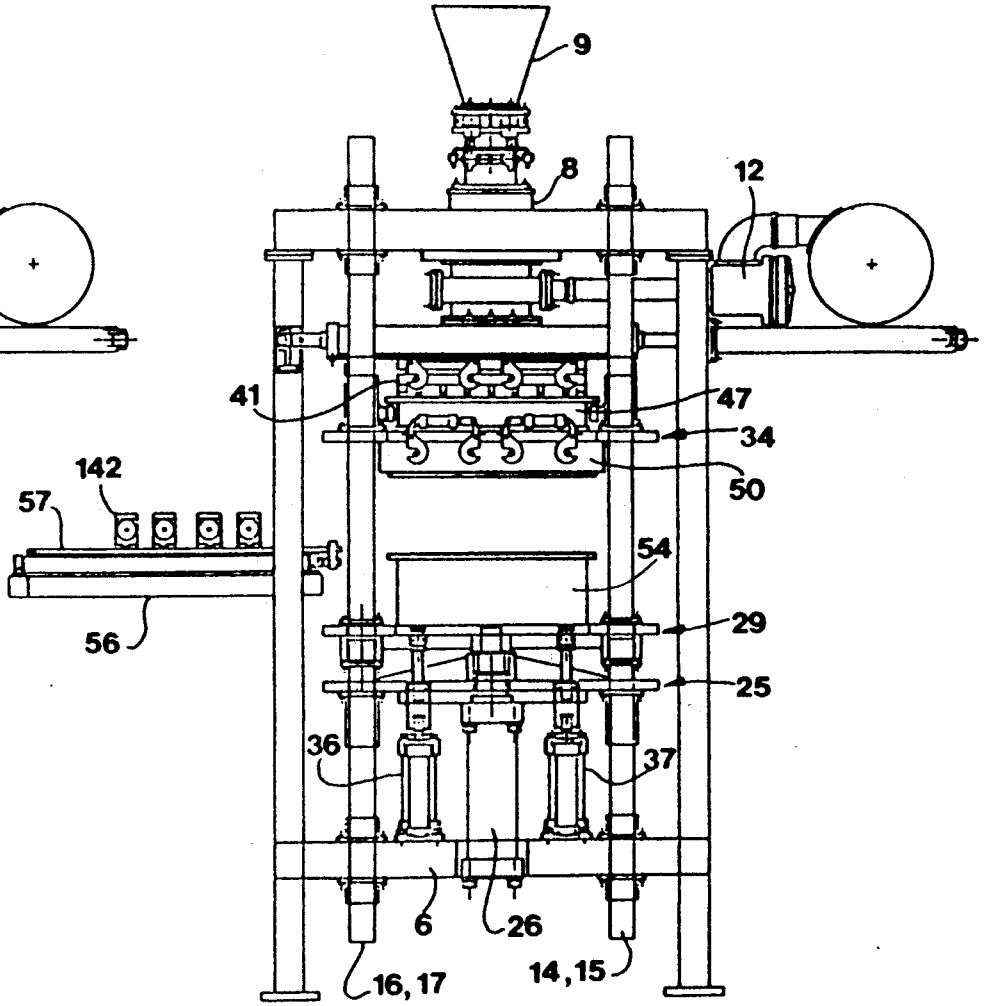

In FIG. 21 the cores are now out of the machine on the picker assembly and both the primary and secondary tables return to their start position as the gassing head shuttles out of the machine. At this point the cycle is completed.

It will be appreciated that the present invention is equally usable in a hot box process rather than in the cold box process illustrated. In the hot box process a gas heater will be employed instead of the gassing head but in any event the drag will remain firmly clamped to the cope during both the blowing operation and the subsequent curing operation, whether that curing operation be by heat or gas.

It can now be seen that there is provided in a cope and drag vertical core blowing machine a first clamp means 26 to clamp the drag to the cope to form the core box, and a second clamp means 36 and 37 to clamp the core box to a blow head and subsequently to a cure head, to solidify the core or cores for removal, all while the first clamp means maintains the cope and drag clamped together under high pressure.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the following claims.

What is claimed is:

1. A foundry core blowing machine, comprising:

a vertically movable core box into which a sand resin is blown;

a horizontally shuttling carriage movable between a first position directly above said core box and a second position horizontally remote from such first position;

a gassing head adapted to be supported on said carriage; and a horizontally extending nozzle mounted on said carriage for separable engagement with said gassing head;

whereby said nozzle and said gassing head are engaged when said gassing head is elevated by said core box slightly above the level of said carriage and said carriage is moved toward such first position, and said nozzle and said gassing head are separated when said gassing head is elevated by said core box slightly above said carriage in such first position and said carriage is moved toward such second position.

2. The core blowing machine of claim 1, wherein said gassing head includes a manifold having an orifice for engagement with said nozzle.

3. The core blowing machine of claim 2, wherein said orifice includes sealing means for preventing curing gas from escaping between said nozzle and said orifice when said nozzle is engaged with said gassing head.

4. The core blowing machine of claim 2, further including adjustment means for vertically adjusting the vertical position of said nozzle prior to engagement with said gassing head.

5. The core blowing machine of claim 4, wherein said adjustment means includes a pressure cylinder.

6. The core blowing machine of claim 4, wherein said nozzle floats in a vertical direction with said gassing head once engaged.

7. The core blowing machine of claim 5, wherein said pressure cylinder maintains a pressure sufficient to at least partly support the weight of said nozzle when said nozzle and said gassing head are engaged.

8. The core blowing machine of claim 5, wherein said adjustment means further includes stop means for limiting the maximum vertical level to which said nozzle may be adjusted.

9. The core blowing machine of claim 8, wherein adjustment to such maximum vertical level positions said nozzle at a level corresponding to the level of said orifice when said gassing head is elevated by said core box slightly above said shuttle.

10. A foundry core blowing machine including a vertically extending clamp to form a core box for the blowing of a sand resin mix therein and a horizontally shuttling gassing head adapted to be positioned above the box and clamped thereagainst, said gassing head being supported on a carriage for such horizontal movement and being lifted off such carriage a short distance when said core box and gassing head are clamped together, a horizontally extending nozzle mounted on said carriage, said nozzle being vertically movable with respect to said carriage, and a manifold orifice on said gassing head whereby said nozzle and orifice may be separated when said gassing head is lifted off said carriage and said carriage is moved horizontally away from said gassing head.

* * * * *